US005500289A

United States Patent [19]

Gavish

[11] Patent Number: 5,500,289

[45] Date of Patent: Mar. 19, 1996

[54] TUNGSTEN-BASED CEMENTED CARBIDE POWDER MIX AND CEMENTED CARBIDE PRODUCTS MADE THEREFROM

[75] Inventor: Ilan Gavish, Karmiel, Israel

[73] Assignee: ISCAR Ltd., Israel

[21] Appl. No.: 493,229

[22] Filed: Jun. 20, 1995

[30] Foreign Application Priority Data

Aug. 15, 1994 [IL] Israel ..... 110663

[51] Int. Cl.[6] ..... B22F 7/06

[52] U.S. Cl. ..... 428/551; 428/552; 428/565; 75/228; 75/230; 75/236; 75/237; 75/238; 75/241; 75/252; 75/255

[58] Field of Search ..... 75/228, 230, 236, 75/237, 238, 241, 252, 255; 428/551, 552, 565

[56] References Cited

U.S. PATENT DOCUMENTS

| | | | |
|---|---|---|---|
| Re. 34,180 | 2/1993 | Nemeth et al. | 428/547 |
| 3,994,692 | 11/1976 | Rudy | 29/182.5 |
| 4,049,876 | 9/1977 | Yamamoto et al. | 428/932 |
| 4,477,263 | 5/1984 | Sugizawa et al. | 75/233 |
| 5,348,806 | 9/1994 | Kojo et al. | 428/552 |
| 5,421,851 | 6/1995 | Oskarsson et al. | 75/238 |

FOREIGN PATENT DOCUMENTS 0365506 4/1990 European Pat. Off. .

*Primary Examiner*—Donald P. Walsh
*Assistant Examiner*—John N. Greaves
*Attorney, Agent, or Firm*—Pennie & Edmonds

[57] ABSTRACT

A sinterable powder mix for the production of a tungsten-based cemented carbide material, said powder mix comprising at least 70% by weight of WC, from about 2 to about 15% by weight of an iron group metal binder, and optionally up to about 15% by weight of one or more carbides, nitrides and carbonitrides of metals of the groups IVb, Vb and VIb of the periodic table; characterized in that said powder mix comprises from about 1 to about 8% by weight of Ta(Nb) oxide and powdered elemental carbon in about the stoichiometric amount required for the reaction:

$$Ta(Nb)_2O_5+7C \rightarrow 2Ta(Nb)C+5CO$$

8 Claims, No Drawings

TUNGSTEN-BASED CEMENTED CARBIDE POWDER MIX AND CEMENTED CARBIDE PRODUCTS MADE THEREFROM

FIELD OF THE INVENTION

The present invention concerns an improved tungsten-based cemented carbide material and a powder mix for the production of that improved material by sintering.

Tungsten-based cemented carbides are most widely used as machine tools of one form or another and generally consist primarily of sintered fine particles of a hard tungsten carbide phase dispersed in a matrix of an iron group metal binder, mostly cobalt, which provides toughness to the brittle carbide and at the same time serves as a sintering aid for cementing the carbide particles to each other. Cemented carbide materials having this WC/Co basic composition are referred to in the trade as "straight" sintered alloys and this term will be used herein. As contrasted to these straight alloys, many tungsten-based cemented carbide compositions presently used are modified by comparatively small (from about 0.25 to about 3%) but important additives, mainly carbides or nitrides of other refractory metals, typically titanium, tantalum, niobium, chromium, vanadium, molybdenum, hafnium or other carbides. Such cemented carbides will be referred to herein as "composite carbides" or "multi" carbide compositions. The main purpose of the aforesaid additives is to inhibit grain growth of the tungsten carbide hard phase so as to maintain a consistently homogeneous fine structure throughout the material, thereby preventing irregularities which may impair the mechanical strength and other properties of the material, inter alia leading to breakages, particularly at corners of the product, e.g. cutting inserts.

One of the more effective grain-growth inhibiting additives traditionally used in both "straight" and composite cemented carbides is tantalum carbide which has conventionally been used in proportions of about 2 to 14%, more frequently from about 6 to 8% by weight of the total powder mix. In the final sintered material, the tantalum carbide is in solid solution with the tungsten carbide and confers improved properties at high cutting edge temperatures, especially where the tool is subjected to considerable shock.

As is well known, commercial tantalum carbide nearly always contains niobium carbide, since, owing to the high chemical similarity between these two elements, their complete separation from each other is difficult and expensive. However, such separation is unnecessary in the manufacture of cemented carbide materials, because niobium has similar beneficial effects to those of tantalum, although at a somewhat lesser degree. In view of the above, the mixture of tantalum and niobium carbides and oxides will be referred to herein as "Ta(Nb)C" and "$Ta(Nb)_2O_5$", respectively. The Ta/Nb ratio in various commercial grades of "tantalum carbide" can vary considerably, in the range of 3:1 to 10:1 and although niobium is less effective than tantalum in improving properties at high cutting edge temperatures, between 10 and 30% niobium, as a proportion of the contained tantalum, is generally accepted as a safe limit.

While advanced tantalum-containing multi-carbides generally provide tools having better cutting performance, they possess the commercially important drawback of being comparatively rather expensive owing to the high price of tantalum carbide. Another drawback observed in "straight" WC/Co cemented carbide compositions supplemented with tantalum carbide is the appearance of larger clusters of tantalum carbide particles (so called "flowers") due to the uneven distribution of the tantalum carbide throughout the bulk of the cemented carbide material.

It is the object of the present invention to provide an improved tungsten-based cemented carbide material which is free of the above-mentioned drawbacks. It is a further object of the invention to provide a sinterable powder mix which can be sintered to form the afore-mentioned improved cemented carbide material.

DESCRIPTION OF THE INVENTION

The above objects were achieved by the present invention by virtue of the surprising finding that, in both straight and composite cemented carbide powder mixes, the Ta(Nb) carbide can be replaced by the considerably less expensive Ta(Nb) oxide with no consequent negative effects on the mechanical properties and durability of the final cemented carbide products obtained by sintering of this powder mix. To the contrary, the final sintered products prepared from the novel powder mix according to the invention, in many cases exhibited even better properties than the corresponding products prepared conventionally from powder mixes comprising Ta(Nb) carbide.

The present invention thus provides, in accordance with a first aspect thereof, a sinterable powder mix for the production of a tungsten-based cemented carbide material, said powder mix comprising at least 70% by weight of WC, from about 2 to about 15% by weight of an iron group metal binder, and optionally up to about 15% by weight of one or more carbides, nitrides and carbonitrides of metals of the groups IVb, Vb and VIb of the periodic table; characterized in that said powder mix comprises from about 1 to about 8% by weight of Ta(Nb) oxide and powdered elemental carbon in about the stoichiometric amount required for the reaction:

$$Ta(Nb)_2O_5+7C \rightarrow 2Ta(Nb)C+5CO$$

In accordance with a second aspect of the present invention, there is provided a tungsten-based cemented carbide material obtained by sintering, according to well known procedures, the above-described powder mix according to the invention.

In the case of straight cemented carbide powder mixes, it has been found in accordance with the invention, that when the tantalum carbide used in a conventional powder mix is replaced by an about equal amount (by weight) of tantalum oxide, there results a final sintered product having a more homogeneous fine structure and practically devoid of the above described tantalum carbide clusters ("flowers") as shown both by microphotographs and by a striking reduction of the standard deviation in the Vickers hardness and the fracture toughness ($K_{IC}$) tests, typically a decrease from 2.8 to 2.1% in the $K_{IC}$ test and from 1.2 to 0.4% in the Vickers hardness test. The improved cemented carbide in accordance with the present invention exhibits comparable and sometimes even higher hardness and fracture toughness, as compared to the conventional straight cemented carbide supplemented by tantalum carbide.

When the concept underlying the present invention is applied to composite cemented carbide powder mixes, i.e. when the tantalum carbide conventionally added to such mixes in amounts of about 4.5 to 7% by weight is fully or partially replaced by tantalum oxide, there is obtained by sintering a cemented carbide product having equal or better mechanical properties as compared to a similar product obtained in the conventional manner by the use of tantalum carbide. This fact by itself already constitutes an economical advantage arising, as explained above, from the much lower cost of tantalum oxide. However, the actual saving in costs of the tantalum carbide raw material has proved to be considerably higher, by a factor of about 2 to 5. The reason is that it has most surprisingly been found, in accordance with the invention, that a sintered carbide product having substantially the same excellent properties can be obtained by substituting the tantalum carbide in the powder mix, wholly or partially, by much smaller proportions—in some cases as little as about 20% (on a weight per weight basis)—of tantalum oxide. It follows that the actual saving in costs in the case of a composite cemented carbide product is increased by a factor of up to 5-fold as compared to the above mentioned saving achieved by the application of the invention to straight cemented carbide materials.

All the operational steps involved in the preparation of the sinterable powder mix according to the invention and in the production therefrom of the final sintered carbide products, namely mixing, milling, addition of lubricants, pressing, lubricant removal, pre-sintering to produce the so-called "green" intermediate product and the final sintering, as well as the optional coating of the final product by chemical vapor deposition or equivalent methods, are substantially the same as the conventional operations well known in this field of cemented carbide production.

The invention will now be described in more detail, with the aid of the following non-limiting examples.

EXAMPLE 1

Preparation of "straight" cemented carbide products

A series of batches of powder mixes were prepared by blending 8% by weight of Co powder with powdered $Ta(Nb)_2O_5$ in amounts ranging from 1.15% to 2.3% by weight and corresponding amounts of carbon powder as indicated in Table 1, with balance amounts (to 100% by weight) of fine WC powder having average grain size of 1.8μ. 1.9% by weight of paraffin and 0.4 ml/gr of acetone were added and the blend was milled for 33 hours in an experimental ball mill. This powder mix was pressed into cutting insert blanks under a pressure of 12 ton/sq.in. and the blanks were sintered at 1420° C. under vacuum for 90 minutes and then cooled under ambient furnace conditions.

The magnetic and mechanical properties of the obtained inserts were compared with a standard straight cemented carbide insert of the Iscar "IC10" series, produced from a powder mix containing 8% Co, 2% Ta(Nb)C, the balance being WC. The results are shown in Table 1.

TABLE 1

| Batch No. | Composition in % by weight: WC | Co | Ta(Nb)C | $Ta(Nb)_5O_2$ | C (added) | SMS[1] (Gem³/gr) | HC[2] (Oe) | T.R.S.[3] (ksi) | HRa[4] | Kd[5] | Density (gr/cm³) | $K_{IC}$[6] (mpa* m^05) |
|---|---|---|---|---|---|---|---|---|---|---|---|---|
| IC 10 | 90 | 8 | 2 | — | — | 164–178 | 175–195 | >310 | 90.6–91.6 | 1.2–1.16 | 14.66–14.79 | 12.5 |
| 90657 | 90.855 | 8 | — | 1.145 | 0.16 | 158 | 187 | 348 | 91.5 | 1.214 | 14.78 | — |
| 90640 | 89.71 | 8 | — | 2.29 | 0.41 | 175 | 181 | 285 | 91.5 | 12.14 | 14.73 | 14.47 |
| 90662 | 89.7 | 8 | — | 2.29 | 0.41 | 177 | 177 | 320 | 91.2 | 12.12 | 14.70 | 13.94 |

[1]Specific magnetic saturation
[2]Magnetic coercivity force
[3]Transverse rupture strength
[4]Rockwell "A" hardness
[5]Shrinkage
[6]Fracture toughness

EXAMPLE 2

Production of composite cemented carbide inserts

A powder mix was prepared by blending 90.05% by weight of finely powdered WC, 6% by weight of Co powder, 2.65% by weight of TiC, 1.3% by weight of $Ta(Nb)_2O_5$ and 0.18% by weight of carbon powder. 2.1% by weight of paraffin and 0.4 ml/gr of acetone were added and the blend was milled in an experimental ball mill (media ratio 5:1 Kg/Kg) for 40 hours (120,000 rotations). The powder mix was pressed under a pressure of 12 ton/sq.in. into cutting insert blanks having the geometry CNMG-432 and the blanks were sintered in accordance with the following procedure:

Heating up to 1200° C. at the rate of 1°–5° C./min, under a pressure of 2 Torr. One hour sintering at 1200° C., whereafter the temperature was raised at the rate of 4° C./min up to 1463° C. under a pressure of 2 Torr until the temperature reached 1290° C. when the furnace was filled with nitrogen gas at a pressure of 10 Torr. Sintering was continued under that pressure of nitrogen at 1470° C. for 70–90 minutes, whereafter the furnace was cooled at the rate of 10° C./min and later at a rate of 5° C./min under full vacuum, down to a temperature of 800° C. Cooling was continued down to room temperature at the rate of 5° C./min under a nitrogen atmosphere.

The sintered inserts exhibited a Vickers hardness of HV20 =1506–1548 (Kg/mm²) and a fracture toughness of $K_{IC}$= 12.5–13.2 (Mpa*m^0.5).

As regards their magnetic properties, the inserts exhibited a specific magnetic saturation of SMS=130–138 (G cm³/gr) and a magnetic coercivity of HC=180–199 (Oe).

The inserts were submitted to honing by sand blasting and thereafter prepared for CVD coating. A TiC-TiN coating was applied at a thickness of 8–9 μm.

The metal cutting performance of two inserts prepared as above was tested as follows:

1. Machining test on carbon steel AISI 1045

The machining conditions were as follows:

| | |
|---|---|
| Speed: V = 260 m/min. | Feed: f = 0.25 mm/rev. |
| Depth of cut: a = 2 mm. | Honing = 0.04 mm. |

The results are shown in the following Table 2.

TABLE 2

| Minutes | Wear (mm) Sample No. 1 | Sample No. 2 |
|---|---|---|
| 2 | 0.07 | 0.076 |
| 8 | 0.11 | 0.105 |
| 12 | 0.13 | 0.14 |
| 16 | 0.19 | 0.155 |
| 18 | — | 0.17 |

2. Milling test on carbon steel AISI 1060

The workpiece had a length of 700 mm and a width of 60 mm.

The conditions were:

Linear speed: V=88 m/min. and n=280 rpm

The results are represented in the following Table 3.

TABLE 3

| No. | mm/min | feed per tooth | Remarks |
|---|---|---|---|
| 1 | 80 | 0.285 | Passed |
| 2 | 100 | 0.357 | Passed |
| 3 | 160 | 0.571 | Passed |
| 4 | 160 | 0.571 | Passed |
| 5 | 200 | 0.714 | Passed |
| 6 | 200 | 0.714 | Passed |
| 7 | 200 | 0.714 | Passed |
| 8 | 250 | 0.89 | Passed |
| 9 | 250 | 0.89 | Passed |

EXAMPLE 3

Production of composite cemented carbide products

A powder mix was prepared by blending 74.8% by weight of finely powdered WC (1.4μ), 11% by weight of Co powder, 7% by weight of TiC, 7.2% by weight of $Ta(Nb)_2O_5$ and 1% by weight of carbon powder. 2.4% by weight of paraffin and 0.4 ml/gr of acetone were added and the blend was milled in an experimental ball mill (media ratio 5:1 Kg/Kg) for 38 hours (114,000 rotations). The powder mix was pressed under a pressure of 12 ton/sq.in. into T.R.S. samples and the samples were sintered at 1420° under vacuum for 90 minutes and then under ambient furnace conditions. The sintered samples exhibited a density of 12.52 (gr/cm$^3$), a transverse rupture strength of T.R.S.=300 (ksi) and a Rockwell "A" hardness of HRa=91.8.

As regards their magnetic properties, the samples exhibited a specific magnetic saturation of SMS=228 (G cm$^3$/gr) and a magnetic coercivity of HC=206 (Oe).

I claim:

1. A sinterable powder mix for the production of a tungsten-based cemented carbide material, said powder mix comprising at least 70% by weight of WC, from about 2 to about 15% by weight of an iron group metal binder, and optionally up to about 15% by weight of one or more carbides, nitrides and carbonitrides of metals of the groups IVb, Vb and VIb of the periodic table; characterized in that said powder mix comprises from about 1 to about 8% by weight of Ta(Nb) oxide and powdered elemental carbon in about the stoichiometric amount required for the reaction:

$$Ta(Nb)_2O_5+7C \rightarrow 2Ta(Nb)C+5CO$$

2. A sinterable powder mix according to claim 1 for the production of a straight tungsten-based cemented carbide material, said powder mix consisting of from about 6 to about 8% by weight of cobalt binder, from about 1 to about 3% by weight of Ta(Nb) oxide and a corresponding amount of powdered elemental carbon as defined in claim 1, the balance being WC.

3. A sinterable powder mix according to claim 2, comprising about 2.3% by weight of Ta(Nb) oxide, about 0.4% by weight of carbon powder and about 8% by weight of cobalt binder, the balance consisting of WC.

4. A sinterable powder mix according to claim 1 for the production of a composite tungsten-based cemented carbide material, said mix comprising about 90% by weight of WC, about 6% by weight of Co, about 2.65% by weight of TiC, about 1.3% by weight of $Ta(Nb)_2O_5$ and about 0.18% by weight of elemental carbon.

5. A tungsten-based cemented carbide product obtained by sintering a powder mix according to claim 1.

6. A straight tungsten-based cemented carbide product obtained by sintering a powder mix according to claim 2 or 3.

7. A composite tungsten-based cemented carbide product obtained by sintering of a powder mix according to claim 4.

8. A cemented carbide metal cutting insert obtained by sintering a powder mix according to claim 1.

* * * * *